US010531737B2

(12) United States Patent
Jones et al.

(10) Patent No.: US 10,531,737 B2
(45) Date of Patent: Jan. 14, 2020

(54) ZERO GRAVITY CHAISE CHAIR SYSTEMS AND METHOD

(71) Applicant: Jolozero LLC, Austin, TX (US)

(72) Inventors: Terry G. Jones, Austin, TX (US); Colin Loeffler, Dallas, TX (US)

(73) Assignee: Jolozero, LLC

( * ) Notice: Subject to any disclaimer, the term of this patent is extended or adjusted under 35 U.S.C. 154(b) by 0 days.

(21) Appl. No.: 15/413,983

(22) Filed: Jan. 24, 2017

(65) Prior Publication Data

US 2018/0206642 A1 Jul. 26, 2018

(51) Int. Cl.
*A47C 1/024* (2006.01)

(52) U.S. Cl.
CPC ..... *A47C 1/0242* (2013.01)

(58) Field of Classification Search
CPC ..... A47C 3/027; A47C 1/0242; A47B 83/02; A47B 2200/0035
See application file for complete search history.

(56) References Cited

U.S. PATENT DOCUMENTS 3,578,379 A 5/1971 Taylor
3,999,799 A * 12/1976 Daswick ..... A47C 3/0257 297/270.3
6,012,774 A * 1/2000 Potter ..... A47C 1/027 297/261.3
6,056,363 A * 5/2000 Maddox ..... A47C 3/0257 297/115
6,382,725 B1 5/2002 Carroll
8,087,724 B2 * 1/2012 Kosik ..... A47C 3/0257 297/170
9,872,561 B1 * 1/2018 Alfaro ..... A47B 51/00
2010/0156065 A1 6/2010 Cerreto et al.
2014/0306502 A1 * 10/2014 Manuel ..... A47C 3/0257 297/261.1

FOREIGN PATENT DOCUMENTS

AU 2013260652 A1 11/2013
JP 2004283553 A 10/2004
WO 2016164281 A1 10/2016

* cited by examiner

*Primary Examiner* — Philip F Gabler
(74) *Attorney, Agent, or Firm* — The Law Firm of H. Dale Langley, Jr., P.C.

(57) ABSTRACT

A zero gravity chaise chair includes a seat frame providing a head rest, a back, a bottom and a leg rest, a first bow member connected to one side of the seat frame, a second bow member connected to the other side of the seat frame, a first rolling guide connected to the first bow, a second rolling guide connected to the second bow, and a base connected to the first rolling guide and the second rolling guide. A motor may operate the first rolling guide to vary incline position of the seat frame. The motor may be algorithmically controlled to vary incline position of the seat frame such as to aid blood flow and minimize pressure points of a body positioned on the seat frame.

27 Claims, 8 Drawing Sheets

ZERO GRAVITY CHAISE CHAIR SYSTEMS AND METHOD

TECHNICAL FIELD

The present invention generally relates to chairs, and more particularly relates to zero gravity lounge chair systems and methods.

BACKGROUND

A variety of chairs are available. Conventional chairs may include fixed seating or lounge type operations. Recliners are common in which the seated occupant may recline the back of the chair and raise a leg support. These recliners are typically manually operated through levers, cams, pinions, and/or pivot pins.

A particular type of reclining chair is a zero gravity chair. In a zero gravity chair, the back reclines and the legs are raised by the chair. Conventional zero gravity chairs have employed cams and pivot point elements for the back and leg support. The conventional zero gravity chairs have been limited in that they employ complex mechanisms for recline and leg support functions. Moreover, the conventional zero gravity chairs have been cumbersome and weighty.

It would therefore be desirable, and a significant improvement in the art and technology, to provide zero gravity chaise chair systems and methods that overcome these deficiencies and provide unique features and operations.

SUMMARY

An embodiment of the invention is a device for seating. The device includes a seat frame, a first bow connected to the seat frame, a second bow connected to the seat frame, a first guide slidingly connected to the first bow, a second guide slidingly connected to the second bow, and a base connected to the first guide and the second guide.

Another embodiment of the invention is a method of manufacture of a device. The method of manufacture includes providing a seat frame, providing a first bow connected to the seat frame, providing a second bow connected to the seat frame, providing a first guide slidingly connected to the first bow, providing a second guide slidingly connected to the second bow, and providing a base connected to the first guide and the second guide.

Yet another embodiment of the invention is a zero gravity chair. The chair includes a seat frame providing a head rest, a back, a bottom and a leg rest, a first bow member connected to one side of the seat frame, a second bow member connected to the other side of the seat frame, a first rolling guide connected to the first bow, a second rolling guide connected to the second bow, and a base connected to the first rolling guide and the second rolling guide.

BRIEF DESCRIPTION OF THE DRAWINGS

The present invention is illustrated by way of example and not limitation in the accompanying figures, in which like references indicate similar elements, and in which.

DETAILED DESCRIPTION

Figure 1:
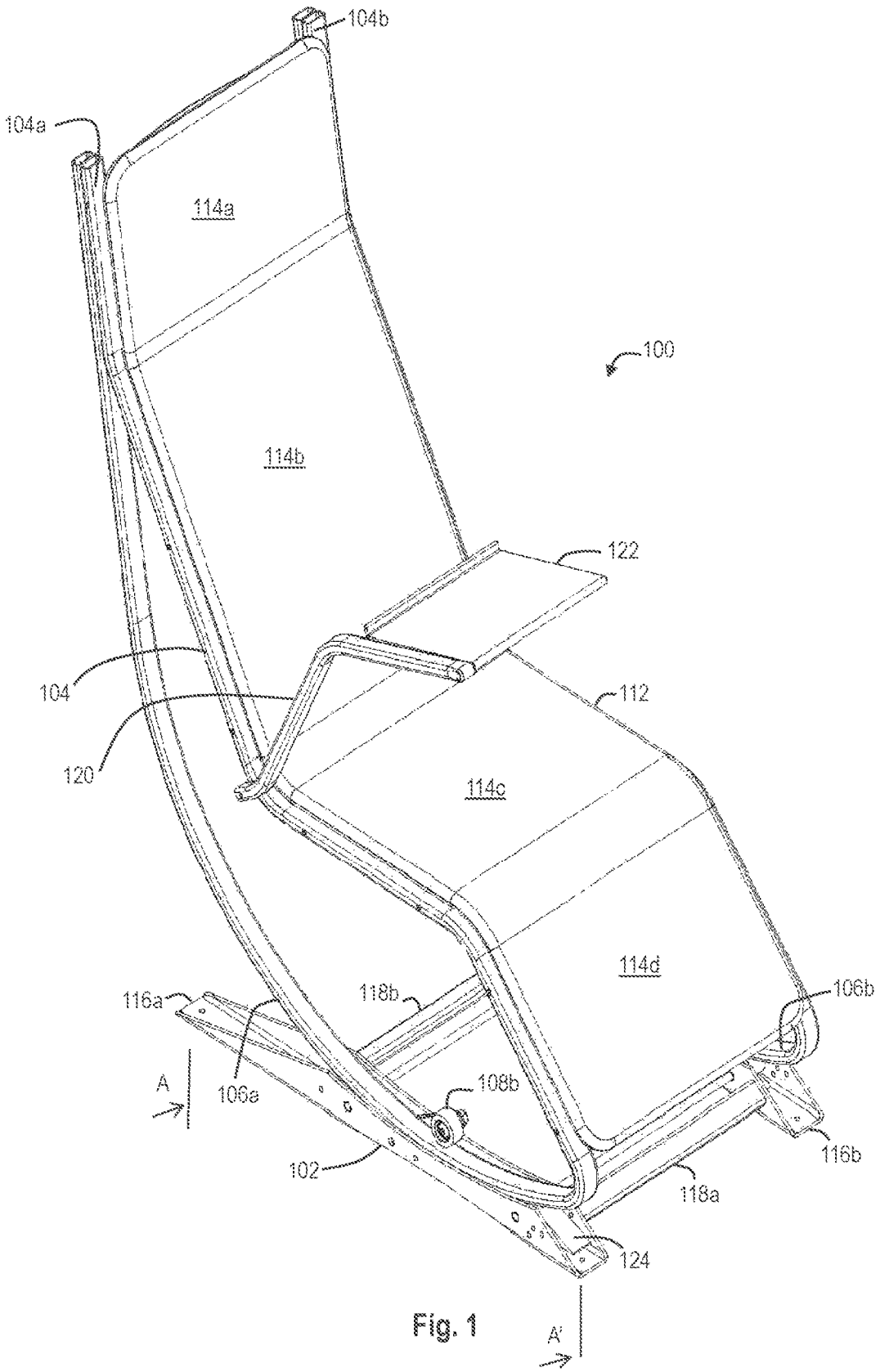
FIG. 1 illustrates a front perspective view of a chair device, according to certain embodiments of the invention.
Figure 2:
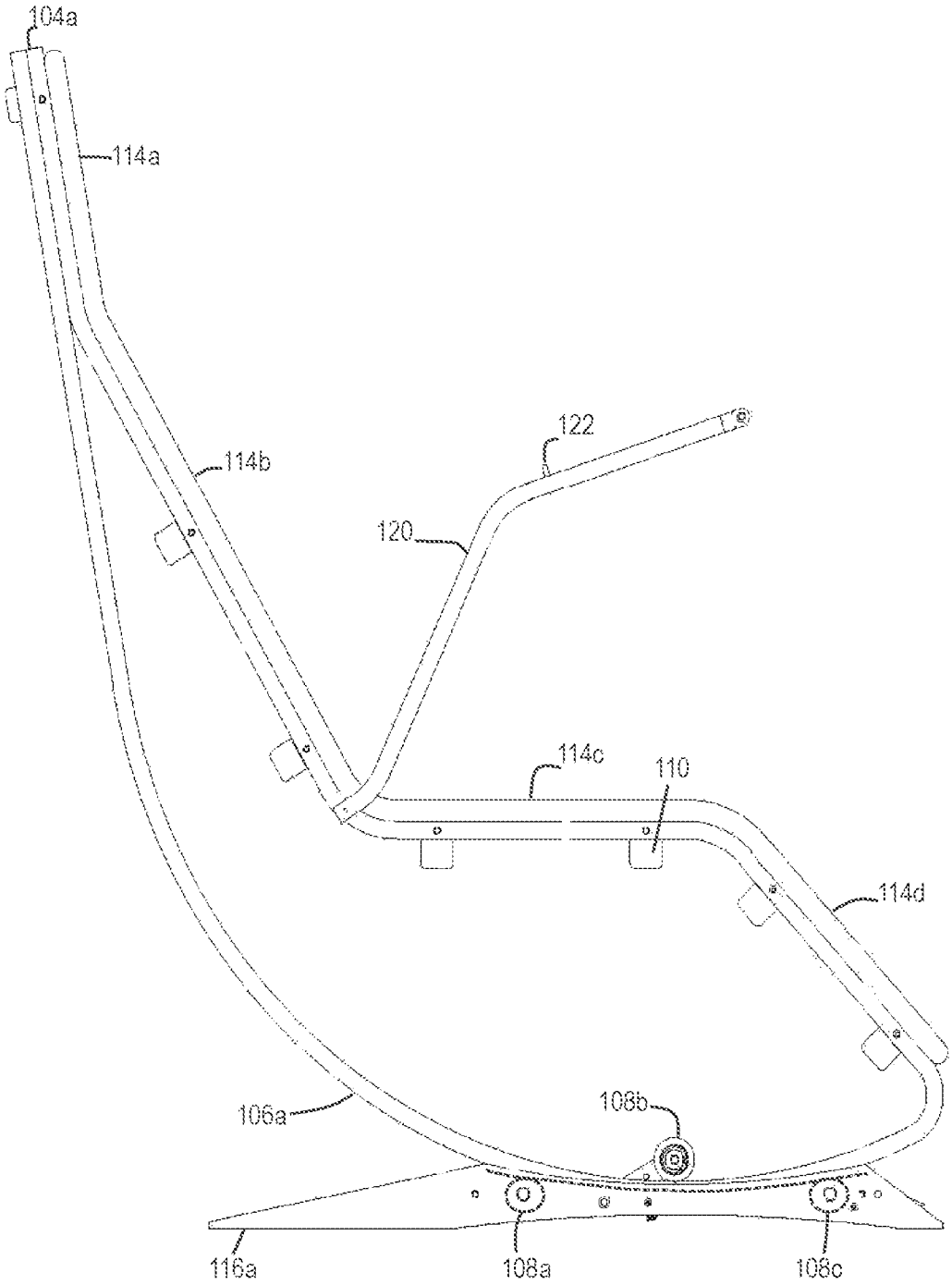
FIG. 2 illustrates a right side view of a chair device, according to certain embodiments of the invention.
Figure 3:
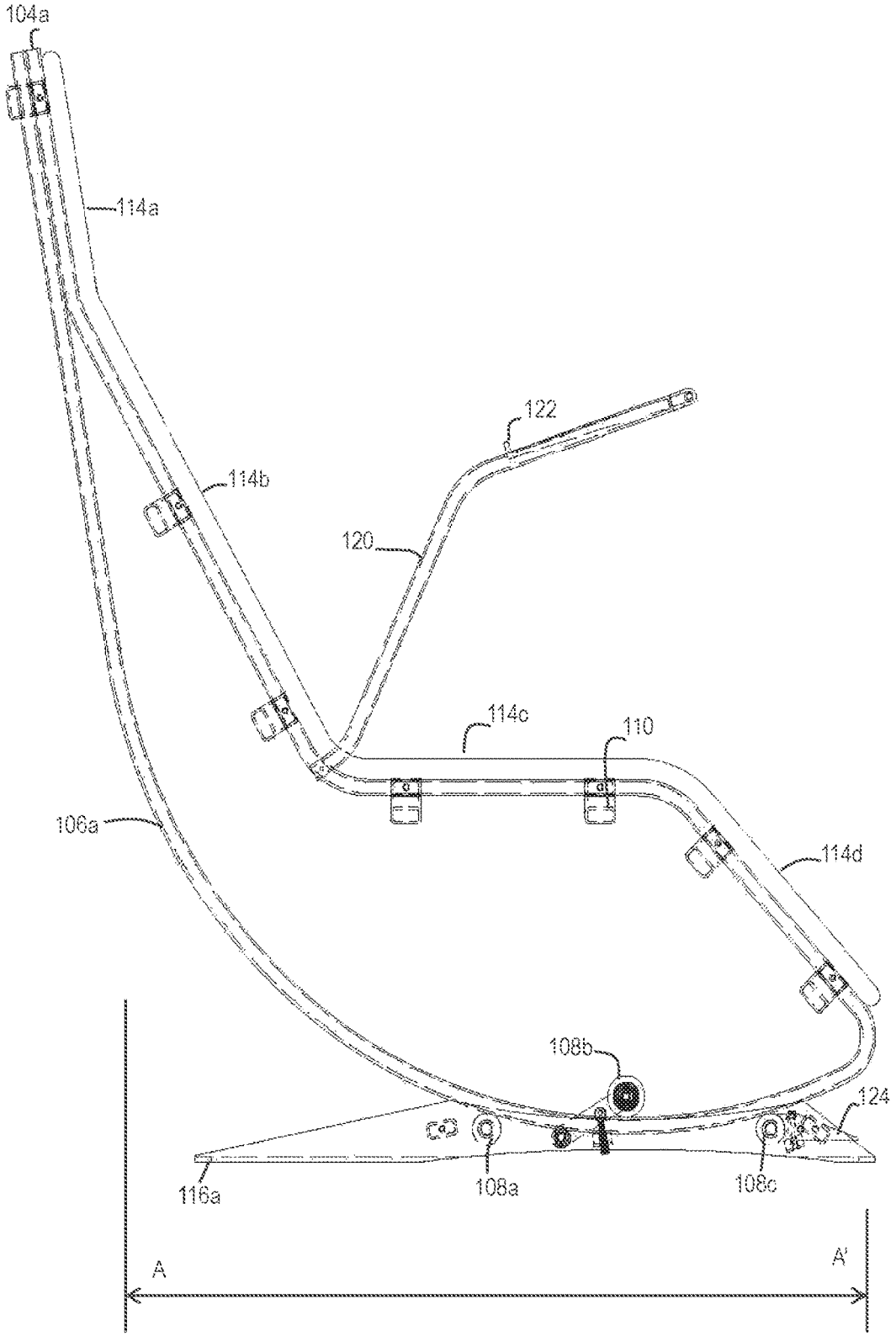
FIG. 3 illustrates a side cutaway view of a chair device, according to certain embodiments of the invention.

Referring to FIGS. 1-3, a non-exclusive example embodiment of a device 100 includes a base 102, a seat frame 104, and left and right bow members 106*a,b*. The left and right bow members 106*a,b* are arcuate and are connected to an underside of the seat frame 104 and slidingly engaged to the base 102 by one or more roller, for example, rollers 108*a-c* and 110*a-c*. respectively, connected to the base 102. The seat frame 104 is formed of opposing left and right side rails 104*a*, 104*b*. The left and right side rails 104*a*, 104*b* are connected by cross bar members 110. A cover 112 connected to the left and right side rails 104*a*, 104*b*, respectively, extends over the seat frame 104. The seat frame 104 and cover 112 form a head rest 114*a*, back 114*b*, bottom 114*c* and leg rest 114*d*.

The base 102 includes a left leg 116*a* and a right leg 116*b* connected by cross support members 118*a,b*. The base 102 is connected to or forms the one or more roller, such as, for example, an upper roller 108*b* and lower rollers 108*a,c* of the left leg 116*a* and an upper roller 110*b* and lower rollers 110*a,c* of the right leg 116*b*. The seat frame 104 forms or is connected to the opposing left and right bow members 106*a*, 106*b*. The left and right bow members 106*a*, 106*b*, respectively, are slidably engaged to rollers 108*a-c* and 110*a-c*, respectively, of each of the legs 116*a,b*, respectively. The left bow 106*a* is engaged to lower rollers 108*a,c* and upper roller 108*b*, and the right bow 106*b* is engaged to lower rollers 110*a,c* and upper roller 110*b*.

A table arm 120 is rotatably connected to the left bow 106*a*, for example, at about the intersection of the back 114*b* and the bottom 114*c*. The table arm 120 is connected to a table 122. The table 122 is rotatably positionable with respect to the table arm 120. The table arm 120 and table 122 may be raised and located in place during use, or else stowed alongside and beneath the seat frame 104 when not in use.

A brake 124 is connected to the base 112 for engaging one or more of the rollers, such as the roller 108*c* beneath the left bow 106*a*. The brake 124 is selectively engageable and disengageable, to respectively restrict and allow sliding movement of the bow 106*a* with respect to the rollers 108*a-c* and the base 112 and consequently the bow 106*b* with respect to the rollers 110*a-c* and the base 112. When the brake 112 is not engaged, the seat frame 104 rotates via the left and right bows 106*a*, 106*b* engaged to the rollers 108*a-c* and 110*a-c*, respectively. When the brake 112 is engaged, the seat frame 104 is retained in position with respect to the base 112 along the left and right bow 106*a*, 106*b* engaged to rollers 108*a-c* and 110*a-c*, respectively.

In operation, a user can position the seat frame 104 via the left and right bow 106*a*, 106*b* with respect to the base 112, in a continuous arc of upright, semi-reclined, and fully reclined position, as desired. The user can position the seat frame 104 via the brake 112, when not seated in the seat frame 104 or when seated. The user forces, such as by foot, the brake into engaged or disengaged position as desired, when the seat frame 114 is desirably positioned along the arc of the left and right bows 106*a*, 106*b*.

The user can also position the table 122 via movement of the table arm 120 into select relationship with the left side rail 104*a*. The table 122 folds over on the table arm 120 to position the table in front of the user and otherwise to selectively locate the table 122 below the seat frame 104 when not in use.

The seat frame 104, left and right bows 106*a,b*, and base 102 are formed of aluminum, metal, steel, composite or other rigid material. The cross bar members 110 are formed of similar tubular material and are bowed in shape to allow a user to sit on the cover 112 of the seat frame 104 without significantly contacting the cross bar members 110. The cover 112 is formed of a cloth, net, webbing, or similar material stretched from the left rail 104*a* to the right rail 104*b*. A pad may be included in or placed on the cover 112.

Figure 7:
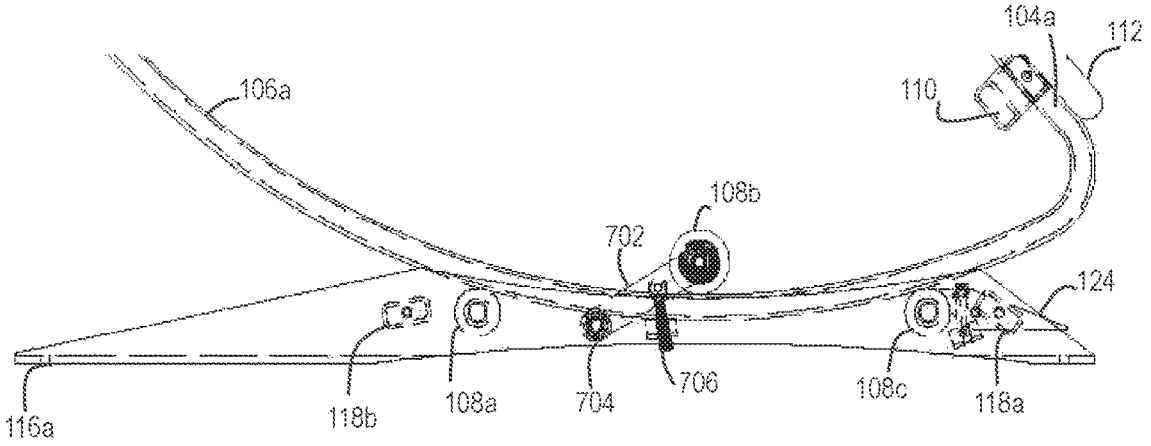
FIG. 7 illustrates a partial cutaway view of rollers and a bow of a chair device, according to certain embodiments of the invention.

Referring to FIG. 7, in conjunction with FIGS. 1-3, the rollers 108*a-c* may include ball bearings or friction fittings. The rollers 108*a-c* are substantially duplicated as the rollers 110*a-c* of the left arm 116*b*. A respective adjustment rod 702 of the rollers 108*b* and 110*b* may connect the rollers 108*b*, 110*b* to a pin 704 of the left and right legs 116*a*, 116*b*, respectively, of the base 102. A respective tensioning device 706 also connects the respective adjustment rod 702 to the left and right legs 116*a*, 116*b*, respectively. The respective adjustment rods 702 may allow for varied tension of the rollers 108*b*, 110*b* against the right and left bows 106*a*, 106*b*, respectively. The respective adjustment rods 702 may also allow shipping of the base 102 separate from the seat frame 104, for joining of the pieces at destination of shipping.

Figure 8:
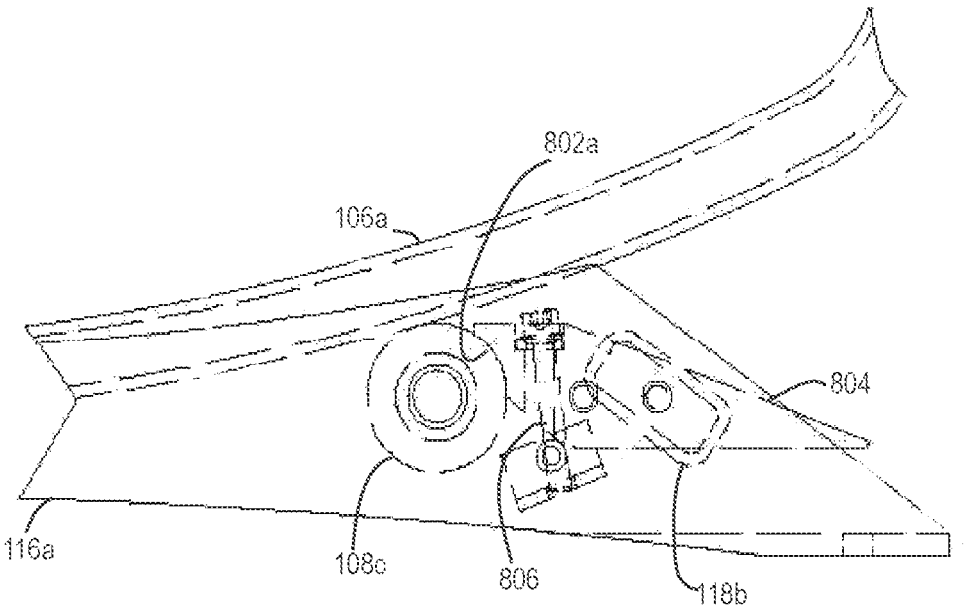
FIG. 8 illustrates a partial cutaway view of a brake of a chair device, according to certain embodiments of the invention.

Referring to FIG. 8, in conjunction with FIGS. 1-3, the brake 124 may include a brake block 802 pivotally connected to the right leg 116*a* by a pivot pin 804. The brake block 802 includes a friction surface 802*a* for selective engagement to the roller 108*c* in order to maintain position of the right bow 106*a* with respect to the roller 108*c*. A bias element connected to the right leg 116*a* and the brake block 802 biases the brake 124 against the roller 108*c* unless the brake 124 is disengaged, such as by the user's foot, from contact of the friction surface 802*a* against the roller 108*c*.

Figure 4C:
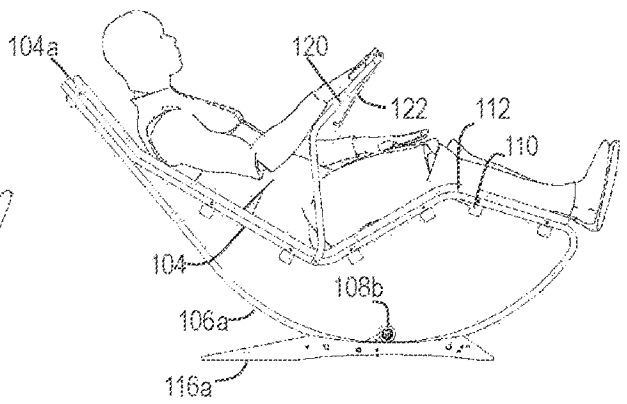
FIGS. 4A-C illustrate a right side view of a chair device in various positions of incline of the seat, according to certain embodiments of the invention.
Figure 4B:
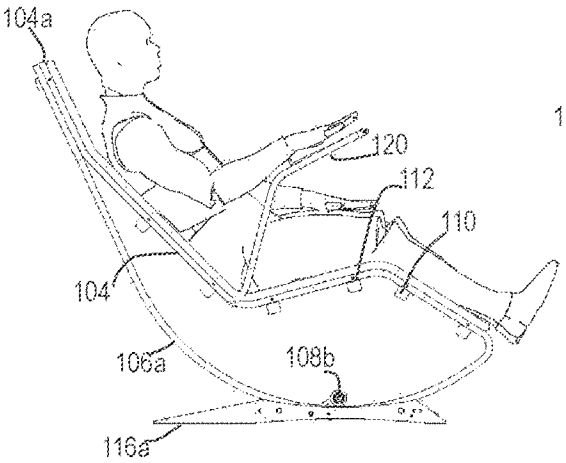
Figure 4A:
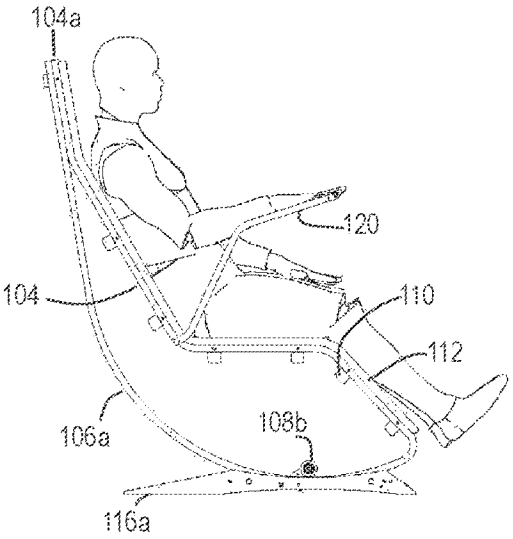

Referring to FIGS. 4A-C, in conjunction with FIGS. 1-3, the rollers 108*a-c*, 110*a-c*, respectively, will guide passage of the right and left bows 106*a*, 106*b*, respectively, in arcuate manner for varied positioning of the seat frame 104. The seat frame 104 may be positioned in any angle of recline, from upright as in FIG. 4A, to semi-reclined as in FIG. 4B, to fully reclined as in FIG. 4C, as well as any other position along the arc of the bows 106*a,b*. The brake 124 can be engaged at any position of the seat frame 104 to stop rotation of the roller 108*c*. Engagement of the brake 124 in this manner retains the seat frame 104 in a fixed position of recline. The brake 124 can alternately be disengaged and the left and right bows 106*a*, 106*b* will slide along the rollers 108*a-c*, 110*a-c*, respectively, to a desired position of the seat frame 104 or else towards maintaining a center of gravity position with loading of the seat frame 104.

Figure 5:
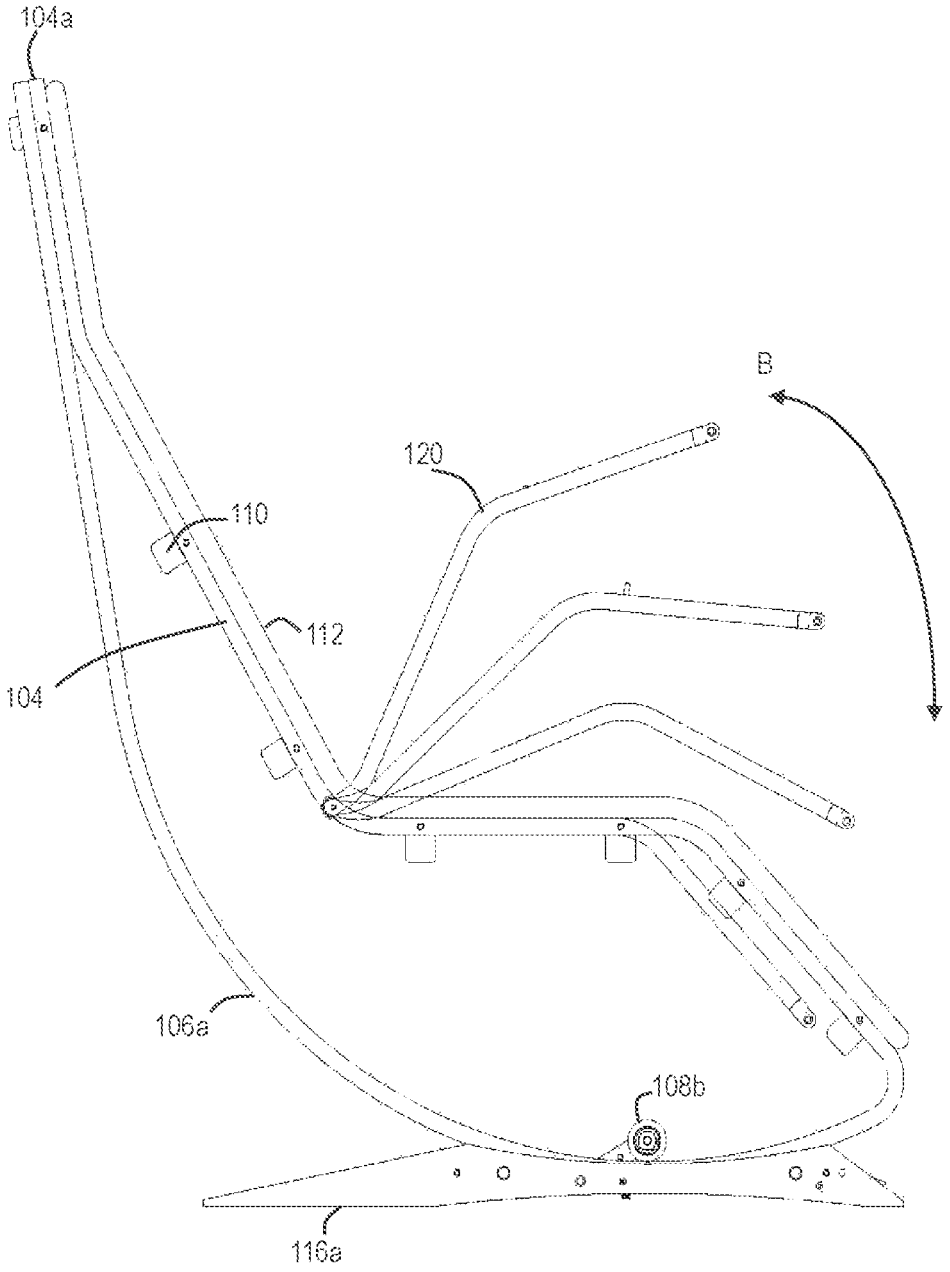
FIG. 5 illustrates a right side view of operation of a table arm of a chair device, according to certain embodiments of the invention.

Referring to FIG. 5, in conjunction with FIGS. 1-3, the table 122 can also be positioned by the table arm 120 in varied arcuate positions indicated by arrow B. The table 122 may be stowed below the seat frame 104 when the table arm 120 is at lowest position. In use, the table 122 may be positioned at various levels along the arrow B. A clamp-type or actuator and knob-type hold or other hinge may allow the table arm 120 to be selectively positioned. The table 122 may be rotated on the table arm 120, such as to stow the table 122 below the seat frame 104 or to locate the table 122 in position for use.

Figure 6:
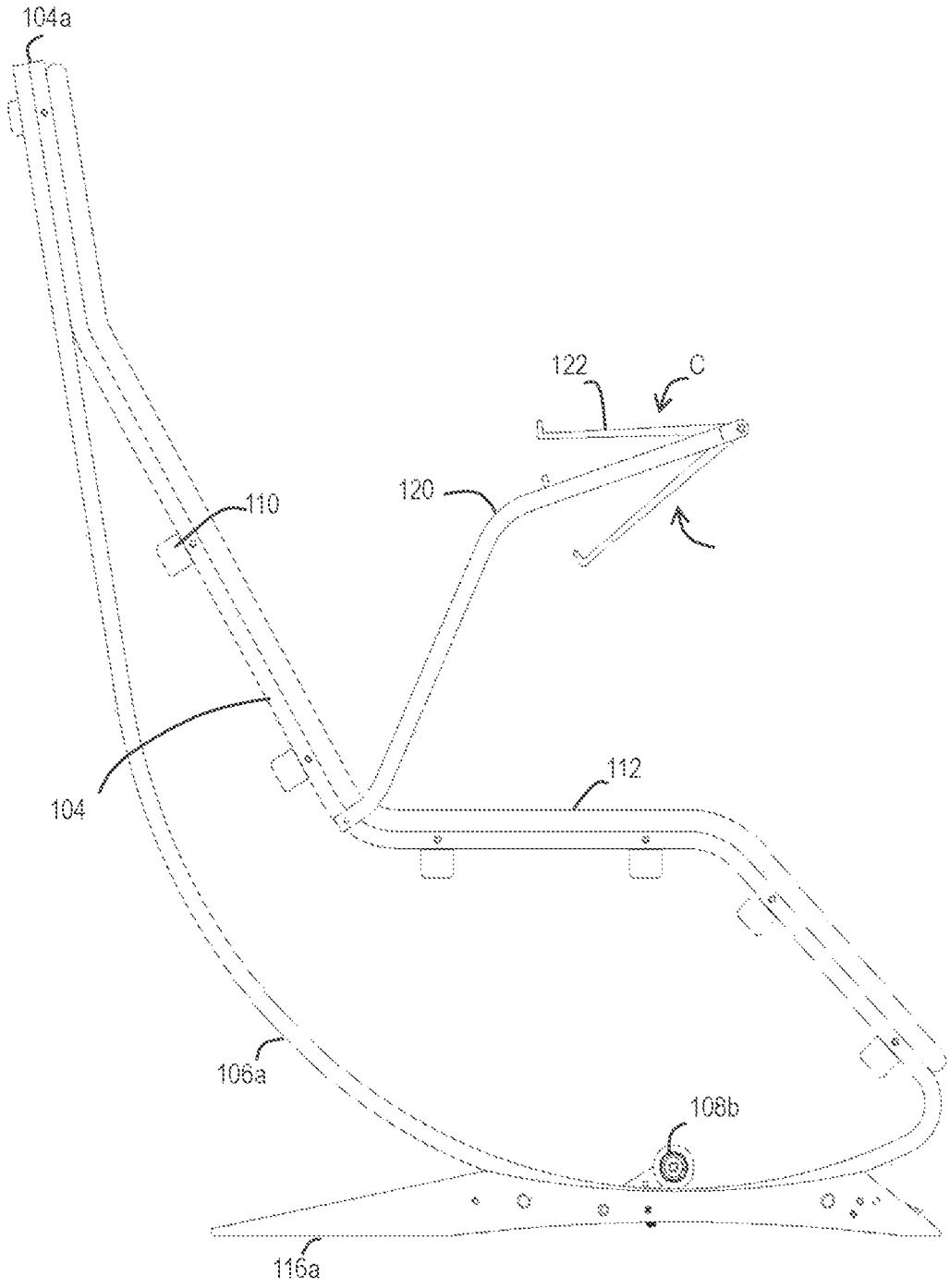
FIG. 6 illustrates a right side view of operation of a table of a table arm of a chair device, according to certain embodiments of the invention.

Referring to FIG. 6, in conjunction with FIGS. 1-3, the table 122, itself, may additionally tilt in connection to the table arm 120 as indicated by arrow C. The tilt may be continuous or in increments, as desired in the embodiment and design. The tilt may be maintained by friction-type hinge or other mechanism.

In certain alternatives, one or more of the rollers 108*a-c*, 110*a-c* is equipped with a motor. The motor may be controlled, such as by a programmable chip, to selectively turn the roller to continuously or intermittently, as per the embodiment, vary incline position of the seat frame 104. Such an automatically changing incline of the seat frame 104 may provide therapeutic effects to, over time of occupancy, relieve pressure points of the body of the user against the seat frame 104.

In other certain alternatives, fewer or more rollers or other restraining members are included for guiding the right and left bows. Other alternatives include varied materials, such as wood, plastic, or metal for the frame and bows. A variety of seat cover and cushioning elements are possible. The seat cover may be cloth or webbing. A memory foam or other cushion may be included in or located atop the seat cover.

In yet further certain alternatives, varied shape and curvature of the bows can provide varied incline operations. Also, shape and curvature of the bows may be adjustable for varied body shapes and sizes. Moreover, shape and features of the seat frame may be varied. The motor may be an electric motor or other motor, and the controller may be communicatively connected to the motor by wire or wireless link.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention.

Benefits, other advantages, and solutions to problems have been described above with regard to specific embodiments. However, the benefits, advantages, solutions to problems and device(s), connection(s) and element(s) that may cause any benefit, advantage, or solution to occur or become more pronounced are not to be construed as a critical, required, or essential feature or element of any or all the claims. As used herein, the terms "comprises, "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A device for seating on a support surface, comprising:

a first tube extending to form a first side of a seat frame including a head rest, a back, a bottom and a leg rest and further extending to form:

a first bow, the first bow arcuately curved back to connect to the first side of the seat frame and extending from the leg rest to the head rest;

a second tube extending to form a second side of the seat frame including the head rest, the back, the bottom and the leg rest and further extending to form a second bow, the second bow arcuately curved back to connect to the second side of the seat frame and extending from the leg rest to the head rest;

cross members connected to the first tube and the second tube along the head rest, the back, the bottom and the leg rest;

the first bow and the second bow each substantially circularly curved below the bottom and leg rest and extending elliptically towards the back and the head rest;

a base formed of a first leg adjacent the first bow and extending along the support surface and a second leg adjacent the second bow and extending along the support surface, the first leg and the second leg are connected by a cross support;

a first guide connected to the first leg and slidingly connected to the first bow; and a second guide connected to the second leg and slidingly connected to the second bow.

2. The device of claim 1, wherein the first guide slidingly connected to the first bow includes at least three guide points and the second guide slidingly connected to the second bow includes at least three guide points.

3. The device of claim 1, further comprising:

a brake connected to the base, the brake is selectively engageable to either the first guide or the second guide to retain the seat frame in select position along curvature of the first bow and the second bow.

4. The device of claim 1, further comprising:

a table arm rotatably connected to the seat frame; and a table tiltingly connected to the table arm.

5. The device of claim 1, wherein the first guide is three guide points with two guide points beneath the first bow and one guide point atop the first bow;

wherein the second guide is three guide points with two guide points beneath the second bow and one guide point atop the second bow.

6. The device of claim 1, further comprising:

a motor connected to the first guide, the motor causes the first guide to vary position of the first bow with respect to the first guide, thereby varying incline position of the seat frame.

7. The device of claim 6, further comprising:

a controller communicatively connected to the motor and connected to the seat frame, the controller controls the motor to operate the first guide to vary position of the first bow with respect to the first guide, thereby varying incline position of the seat frame.

8. The device of claim 7, wherein the controller algorithmically causes the motor to adjust incline position of the frame and thereby position of a body on the frame, to aid blood flow of the body.

9. The device of claim 7, wherein the controller algorithmically causes the motor to adjust incline position of the frame and thereby position of a body on the frame, to minimize pressure points against the body.

10. The device of claim 1, further comprising:

a brake connected to the base, the brake is selectively engageable to the first guide to retain the seat frame in select position along curvature of the first bow and the second bow;

a table arm rotatably connected to the seat frame; and a table tiltingly connected to the table arm.

11. A method of manufacture of seating, the seating for location on a support surface, comprising:

providing a first tube;

forming the first tube as a first bow of a first side of a seat frame of a head rest, a back, a bottom and a leg rest and to curve back with substantially circular curve below the bottom and leg rest and extension elliptically towards the back and the head rest;

providing a second tube;

forming the second tube as a second bow of a second side of a seat frame of the head rest, the back, the bottom and the leg rest and to curve back with substantially circular curve below the bottom and leg rest and extension elliptically towards the back and the head rest;

connecting cross members to the first side and the second side along the head rest, the back, the bottom and the leg rest;

providing a base formed of a first leg adjacent the first bow and a second leg adjacent the second bow, the first leg and the second leg extending along the support surface, the first leg and the second leg are connected by a cross support;

providing a first guide connected to the first leg and slidingly connected to the first bow; and providing a second guide connected to the second leg and slidingly connected to the second bow.

12. The method of manufacture of claim 11, wherein the first guide includes at least two guide points below the first bow and one guide point atop the first bow and the second guide includes at least two guide points below the second bow and one guide point atop the second bow.

13. The method of manufacture of claim 11, further comprising:

providing a brake connected to the base for selective engagement to the first guide.

14. The method of manufacture of claim 11, further comprising:

providing a table arm rotatably connected to the seat frame; and providing a table tiltingly connected to the table arm.

15. The method of manufacture of claim 11, further comprising:

providing a motor connected to the first guide; and providing a controller communicatively connected to the motor.

16. The method of manufacture of claim 15, wherein the controller algorithmically causes the motor to adjust incline position of the frame and thereby position of a body on the frame, to aid blood flow of the body.

17. The method of manufacture of claim 15, wherein the controller algorithmically causes the motor to adjust incline position of the frame and thereby position of a body on the frame, to minimize pressure points against the body.

18. A zero gravity chaise chair for locating on a support surface, comprising:

a first side of a seat frame formed of a first tube outlining a head rest, a back, a bottom and a leg rest and folded back to complete a first bow arcuately curved back to connect to the first tube adjacent the first bow extending from extent of the leg rest to extent of the head rest, the first bow being generally circular below the bottom and the leg rest and extending elliptically towards the back and the head rest;

a second side of the seat frame formed of a second tube outlining the head rest, the back, the bottom and the leg rest and folded back to complete a second bow arcuately curved back to connect to the second tube adjacent the second bow extending from extent of the leg rest to extent of the head rest, the second bow being generally circular below the bottom and the leg rest and extending elliptically towards the back and the head rest;

cross member connected to the first tube and the second tube along the head rest, the back, the bottom and the leg rest;

a base of a first leg adjacent the first bow member and a second leg adjacent the second bow member, the first leg and the second leg connected by a cross support and extending along the support surface;

a first rolling guide rollingly connected to the first bow and connected to the first leg; and a second rolling guide rollingly connected to the second bow and connected to the second leg.

19. The zero gravity chair of claim 18, further comprising:

a brake connected to the base for selective engagement to the first rolling guide to retain incline position of the seat frame.

20. The zero gravity chair of claim 19, wherein the first rolling guide and the second rolling guide are each, respectively, three rollers connected to the base.

21. The zero gravity chair of claim 20, wherein the brake selectively engages at least one of the three rollers of the first rolling guide.

22. The zero gravity chair of claim 21, further comprising:

a table arm connected to the seat frame; and a table connected to the table arm.

23. The zero gravity chair of claim 18, further comprising:

a motor connected to the first rolling guide.

24. The zero gravity chair of claim 23, further comprising:

a controller for the motor communicatively connected to the motor, the controller includes a program for controlling the motor to automatically and selectively vary incline position of the seat frame over time.

25. The zero gravity chair of claim 24, wherein the controller is an app wirelessly communicatively connected to the motor.

26. The zero gravity chair of claim 24, wherein the controller algorithmically causes the motor to adjust incline position of the frame and thereby position of a body on the frame, to aid blood flow of the body.

27. The zero gravity chair of claim 24, wherein the controller algorithmically controls the motor to adjust incline position of the frame and thereby position of a body on the frame, to minimize pressure points against the body.

* * * * *